US007789484B2

(12) United States Patent
Takada et al.

(10) Patent No.: US 7,789,484 B2
(45) Date of Patent: Sep. 7, 2010

(54) PRINTER-PLOTTER AND METHOD FOR PRINTING AND CUTTING

(75) Inventors: Masanori Takada, Tomi (JP); Tadanori Ipponyari, Tomi (JP); Eiji Miyashita, Tomi (JP); Tetsuharu Ikeda, Tomi (JP); Akio Kobayashi, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 121 days.

(21) Appl. No.: 12/054,248

(22) Filed: Mar. 24, 2008

(65) Prior Publication Data

US 2008/0238996 A1 Oct. 2, 2008

(30) Foreign Application Priority Data

Mar. 30, 2007 (JP) ..... 2007-090534

(51) Int. Cl.
*B41J 23/00* (2006.01)

(52) U.S. Cl. ..... 347/37; 347/40

(58) Field of Classification Search ..... 347/19, 347/20, 37, 40–43, 84–86, 4, 5
See application file for complete search history.

(56) References Cited

U.S. PATENT DOCUMENTS 5,949,443 A * 9/1999 Yamamoto et al. ..... 347/3
6,692,097 B2 * 2/2004 Arima et al. ..... 347/15
7,104,643 B2 * 9/2006 Glass et al. ..... 347/105

FOREIGN PATENT DOCUMENTS

JP 7-256960 10/1995
JP 9-66698 3/1997

* cited by examiner

*Primary Examiner*—Thinh H Nguyen
(74) *Attorney, Agent, or Firm*—Ditthavong Mori & Steiner, P.C.

(57) ABSTRACT

A printer-plotter includes first and second heads which are supported by a guide rail and are movable along a longitudinal direction of the guide rail, independently. A driving member is supported by the guide rail and configured to move along the longitudinal direction between the first head and the second head. A first connecting mechanism is configured to connect the first head to the driving member detachably. A second connecting mechanism is configured to connect the second head to the driving member detachably. The first head is connected to the driving member by the first connecting mechanism and the second head is separated from the driving member in order to make the first head operate. The second head is connected to the driving member by the second connecting mechanism and the first head is separated from the driving member in order to make the second head operate.

20 Claims, 14 Drawing Sheets

PRINTER-PLOTTER AND METHOD FOR PRINTING AND CUTTING

CROSS-REFERENCE TO RELATED APPLICATIONS

The present application claims priority under 35 U.S.C. §119 to Japanese Patent Application No. 2007-090534, filed Mar. 30, 2007, entitled "Printer-Plotter Apparatus." The contents of this application are incorporated herein by reference in their entirety.

BACKGROUND OF THE INVENTION

1. Field of the Invention

The present invention relates to a printer-plotter and a method for printing and cutting.

2. Discussion of the Background

Printer is an apparatus for printing on a surface of a sheet-like medium by, for example, ejecting ink droplets from an inkjet head while moving the inkjet head in anteroposterior and lateral directions (horizontally) relative to the sheet-like medium. Plotter is an apparatus for conducting the cutting process relative to a sheet-like medium by moving a cutting head in anteroposterior and lateral directions relative to the sheet-like medium while holding a cutter of the cutting head in contact with the sheet-like medium. For moving each of the heads of these apparatuses in the anteroposterior and lateral directions relative to the sheet-like medium, there is known an arrangement in which the head is supported by a guide rail extending in the lateral direction above the medium such that the head is movable in the lateral direction along the guide rail and the sheet-like medium is fed in the anteroposterior direction. There is also known an arrangement in which the sheet-like medium is fixed and supported on a flat plate and a guide rail which supports the head movably in the lateral direction moves in the anteroposterior direction above the sheet-like medium which is fixed as mentioned above.

There is also known an apparatus including an inkjet head and a cutting head which are supported on a guide rail so that the apparatus has functions as a printer in addition to a plotter (a plotter with print function). For example, Japanese Patent No. 3333312 and Japanese Patent No. 3645012 disclose such apparatuses. The contents of these patents are incorporated herein by reference in their entirety. By using such a plotter with print function, the space and the cost can be reduced as compared to a case using separately a printer and a plotter.

In the plotter with print function as disclosed in Japanese Patent No. 3333312 or Japanese Patent No. 3645012, the cutting head is attached to a belt which is driven by driving force of an electric motor similarly to a conventional plotter so that the cutting head is moved in the lateral direction according to the movement of the belt. In addition, an inkjet head is detachably attached to the cutting head which is moved in the lateral direction according to the movement of the belt. When the inkjet head is detached from the cutting head, the inkjet head is connected to a fixing member at an end of the guide rail so that the inkjet head is held not to move. During cutting process relative to a sheet-like medium by this plotter with print function having the aforementioned structure, the inkjet head is separated from the cutting head and is fixed to the fixing member so that only the cutting head is moved in the lateral direction. During printing process relative to a sheet-like medium, the inkjet head is detached from the fixing member and is connected to the cutting head so that the inkjet head is moved together with the cutting head in the lateral direction.

According to the plotter with print function having the aforementioned structure, both two heads are connected and are thus moved together during the printing process. For the movement, large belt driving force is required and an electric motor for driving the belt is thus required to have a large capacity, thus leading to increase in size and cost of the apparatus. Further, since the inkjet head is connected directly to the cutting head during the printing, ink droplets ejected from the inkjet head for printing may adhere to the cutting head so that the cutting head may be contaminated. Particularly when a solvent ink is used for printing, coatings of electric wires and harnesses for transmitting power and control signals to electric parts in the cutting head may be dissolved due to the adhesion of the solvent ink, leading to operation error of the cutting head. It should be noted that if the coatings of the electric wires and harnesses are made of a material having ink resistance, there is a problem of high cost of production of the apparatus because such a material is expensive.

SUMMARY OF THE INVENTION

According to one aspect of the present invention, a printer-plotter includes a first head, a second head, a driving member, a first connecting mechanism and a second connecting mechanism. The first head is supported by a guide rail and movable along a longitudinal direction of the guide rail. The second head is supported by the guide rail and movable independently of the first head along the longitudinal direction. The driving member is supported by the guide rail and configured to move along the longitudinal direction between the first head and the second head. The first connecting mechanism is configured to connect the first head to the driving member detachably. The second connecting mechanism is configured to connect the second head to the driving member detachably. The first head is connected to the driving member by the first connecting mechanism and the second head is separated from the driving member in order to make the first head operate. The second head is connected to the driving member by the second connecting mechanism and the first head is separated from the driving member in order to make the second head operate.

According to another aspect of the present invention, a method for printing and cutting includes providing a guide rail extending along a longitudinal direction; providing a printing head supported by the guide rail and movable along the longitudinal direction; providing a cutting head supported by the guide rail and movable independently of the printing head along the longitudinal direction; moving a driving member on the guide rail along the longitudinal direction between the printing head and the cutting head; connecting the printing head to the driving member detachably to perform printing while the cutting head is separated from the driving member; and connecting the cutting head to the driving member detachably to perform cutting while the printing head is separated from the driving member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
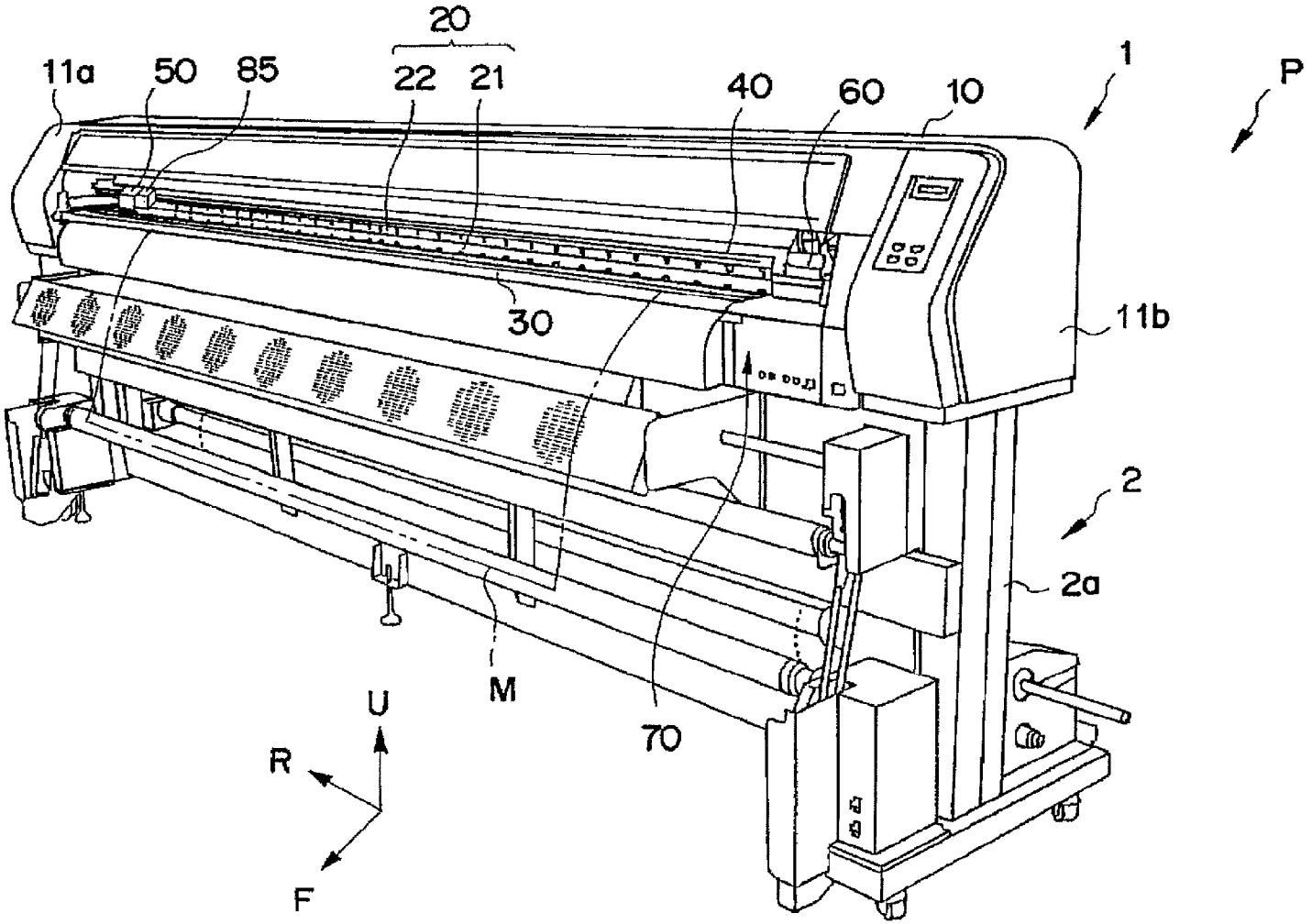
FIG. 1 is a perspective view showing the appearance of a printer-plotter according to an embodiment of the present invention.

The embodiments will now be described with reference to the accompanying drawings, wherein like reference numerals designate corresponding or identical elements throughout the various drawings. It should be noted that the directions of arrows F, R, U marked in the drawings are forward, rightward, upward in the following description, respectively.

A printer-plotter of which entire appearance is shown in FIG. 1 includes a main unit 1 for conducting a predetermined action such as printing to a sheet-like medium M such as a roll of paper and a supporting unit 2 having a pair of right and left legs 2*a* by which the main unit 1 is supported. The main unit 1 includes a body 10 fixed to the upper ends of the legs 2*a*, a feeding mechanism 20 for feeding the sheet-like medium M in the anteroposterior direction, a platen 30 for supporting the sheet-like medium M, a guide rail 40 extending in the lateral direction above the platen 30, a cutting head 50 and an inkjet head 60 which are supported by the guide rail 40 and are movable along the guide rail 40 in the lateral direction.

Figure 2:
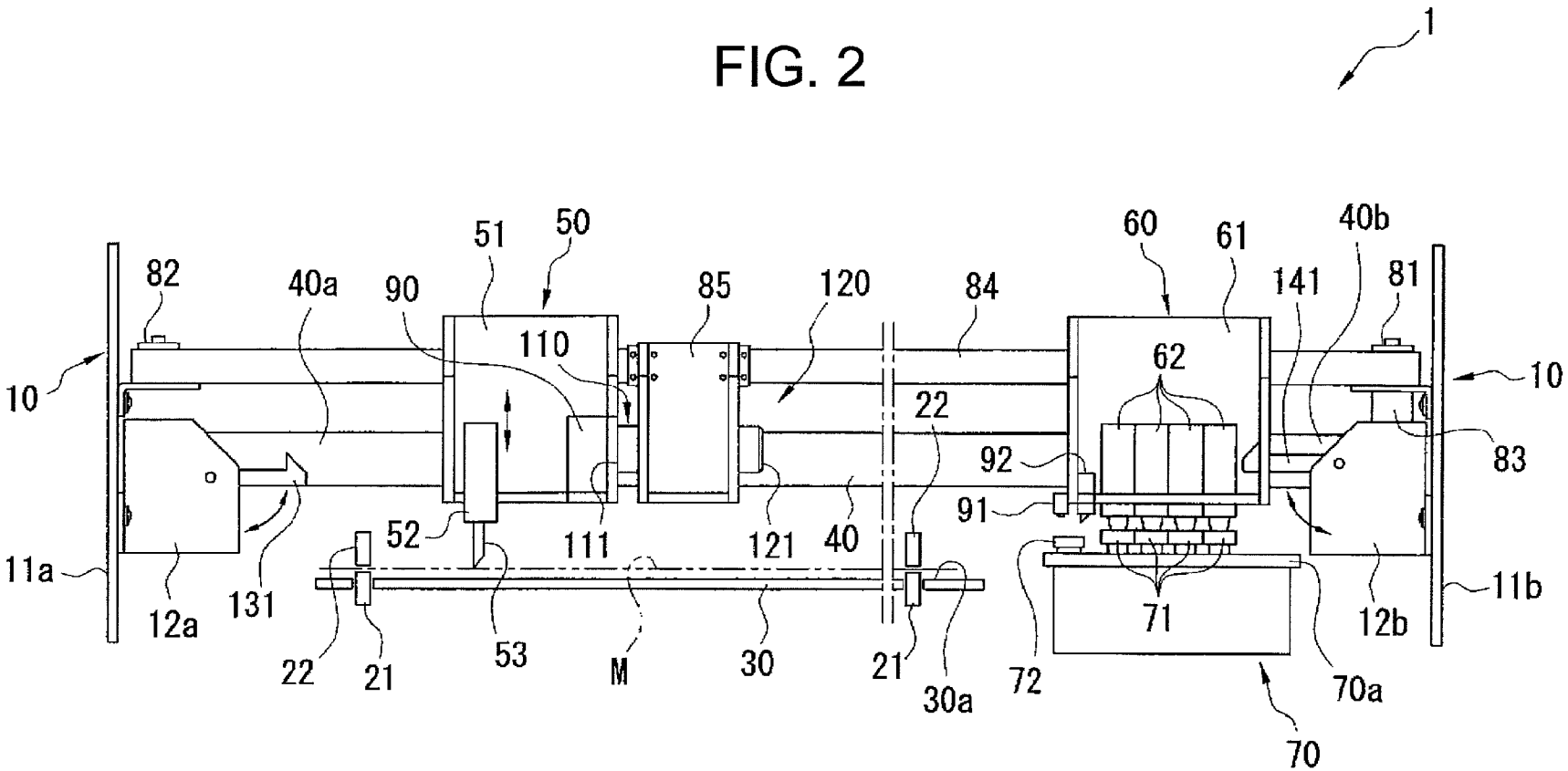
FIG. 2 is an illustration showing a main unit of the printer-plotter.
Figure 3:
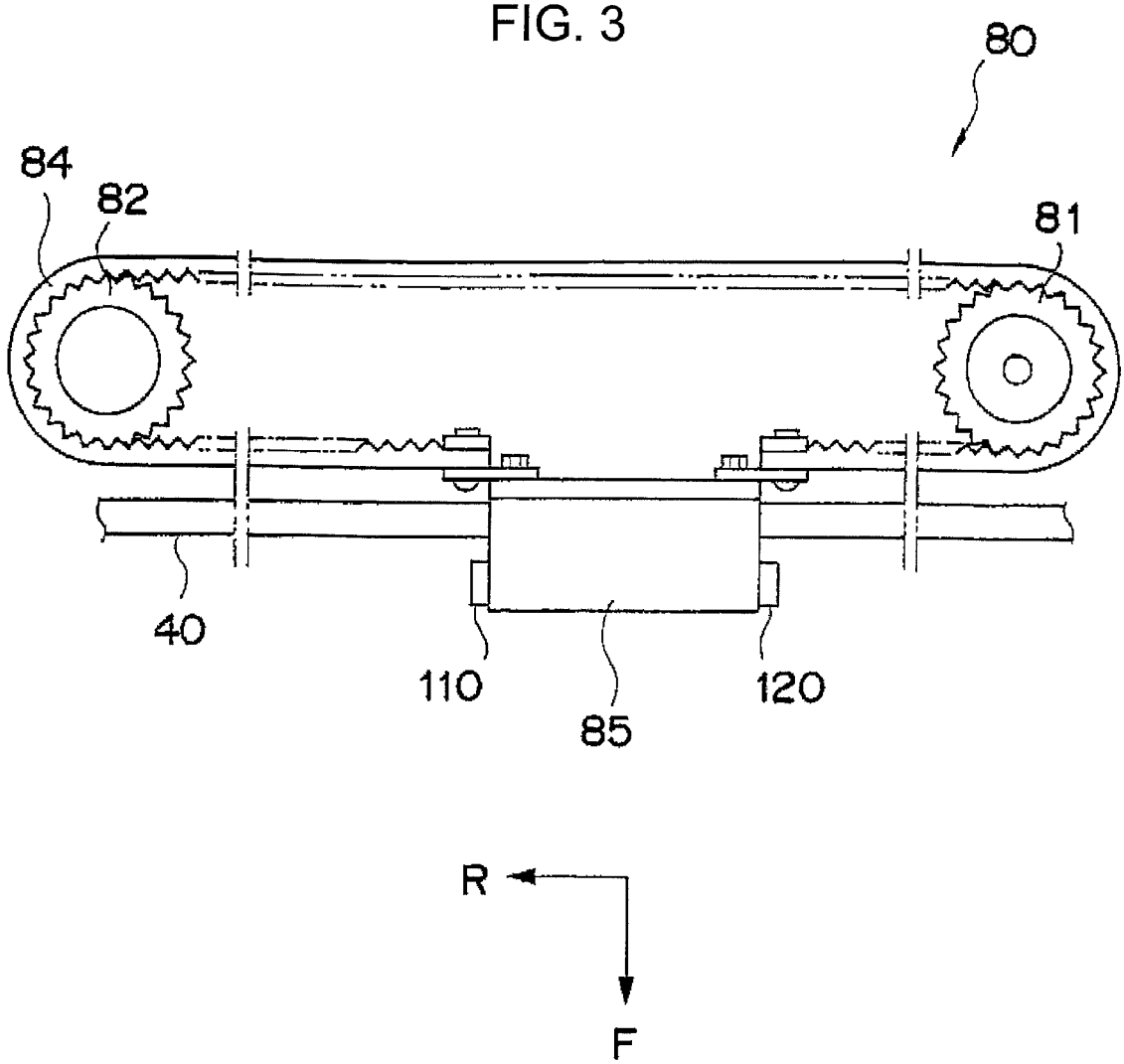
FIG. 3 is a schematic illustration showing the structure of a head driving device of the printer-plotter in a plan view.
Figure 4:
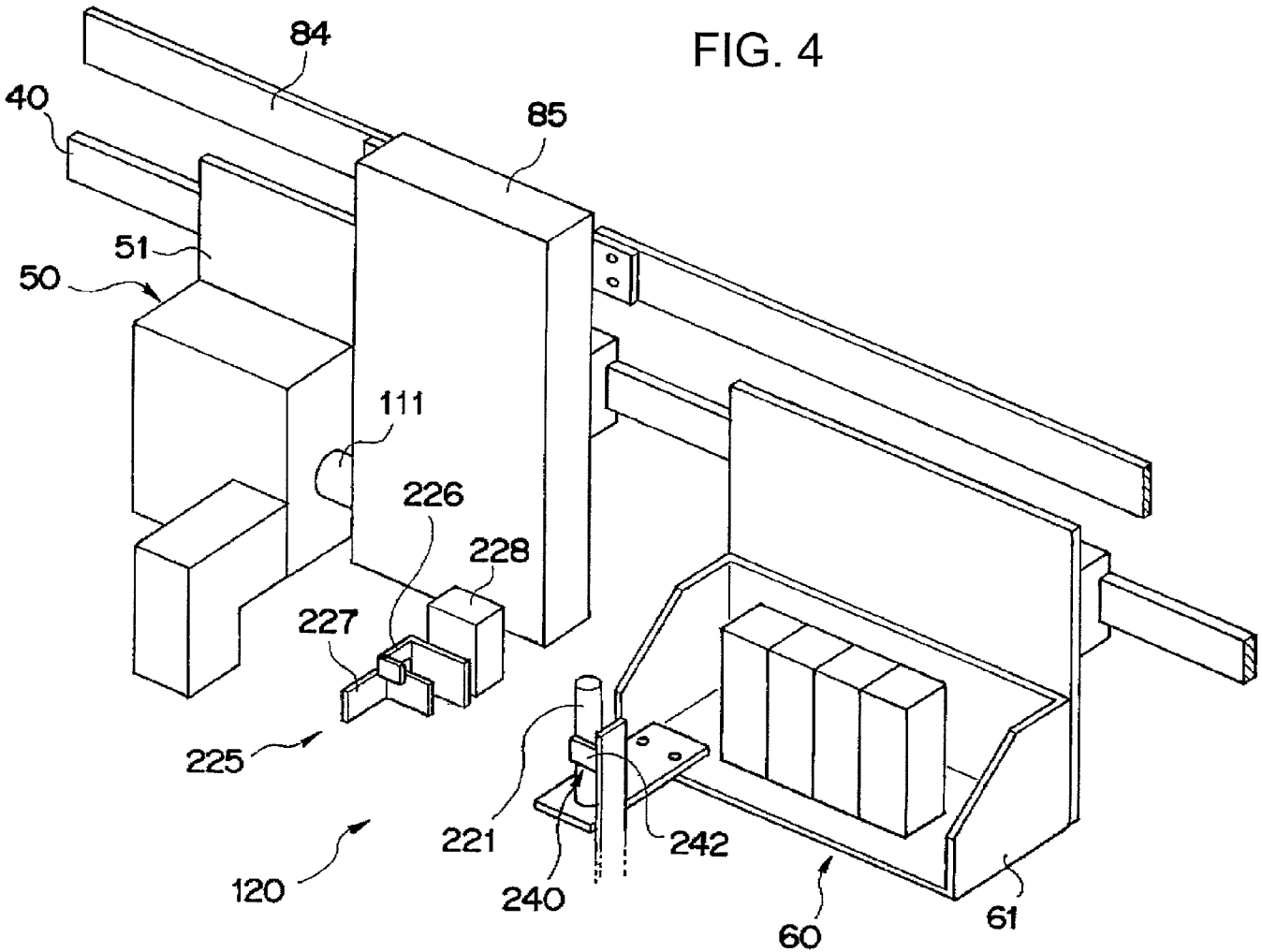
FIG. 4 is a perspective view showing a connecting mechanism of a printer-plotter according to another embodiment of the present invention.
Figure 5A:
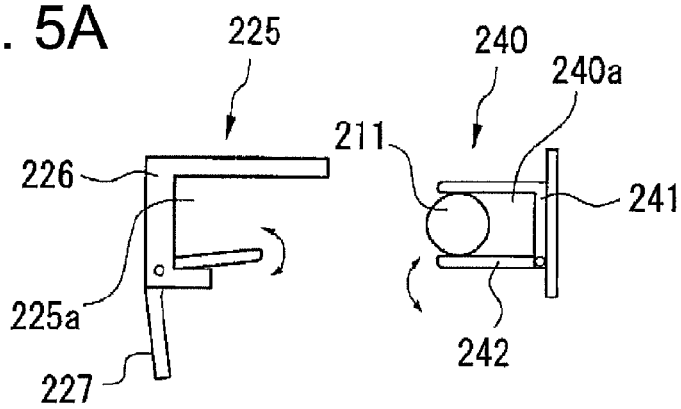
FIGS. 5A-5D schematically show the structure and actions of main parts of the connecting mechanism, FIG. 5A showing a state where an inkjet head is connected to a body side, FIG. 5B showing a state where the inkjet head and a driving carriage starts to connect to each other, FIG. 5C showing a state where the inkjet head and the driving carriage are connected, FIG. 5D showing a state where the inkjet head starts to connect to the body side.
Figure 5B:
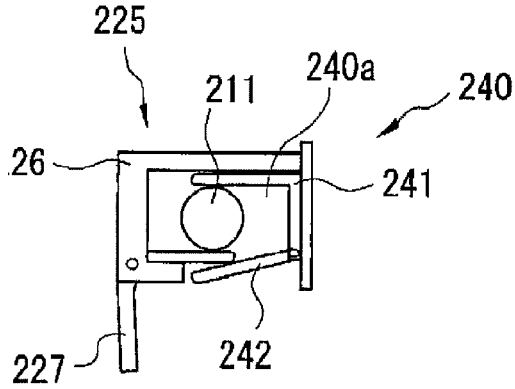
Figure 5C:
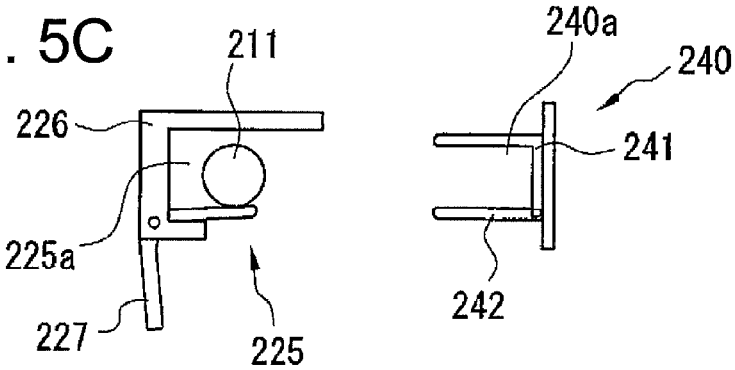
Figure 5D:
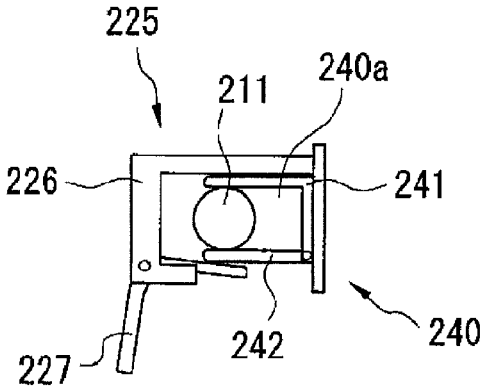

The body 10 has right and left side walls 11*a*, 11*b*. As seen from FIG. 2 showing its internal structure, the right and left ends of the guide rail 40 are connected to and supported by the side walls 11*a* and 11*b*, respectively so that the guide rail 40 extends in the lateral direction between the side walls 11*a* and 11*b*. The feeding mechanism 20 includes pairs of feeding rollers 21 and press rollers 22 as which are disposed on a front side of the apparatus so that the pairs are aligned in the lateral direction. Each pair includes the feeding roller 21 and the press roller 22 as a lower roller and an upper roller which are rotatable in both the normal and reverse directions about respective rotary shafts extending in the lateral direction. In the state where the sheet-like medium M is inserted between the feeding rollers 21 and the press rollers 22, the feeding rollers 21 are rotated by an electric motor and the press rollers 22 are also rotated according to the rotation of the feeding rollers 21, whereby the sheet-like medium M is fed in the anteroposterior direction. The platen 30 is disposed between the right and left side walls 11*a* and 11*b* and is provided on its upper surface with a supporting surface 30*a* for horizontally supporting the sheet-like medium M. The supporting surface 30*a* is provided with a number of holes formed therein in which negative pressure can act. Therefore, the sheet-like medium M is sucked to the supporting surface 30*a* by the negative pressure so that the sheet-like medium M can be securely held on the supporting surface 30*a*.

The cutting head 50 includes a carriage 51 which is attached to and movable along the guide rail 40 in the lateral direction, and a cutter holder 52 which is attached to the carriage 51. The cutter holder 52 is supported such that the cutter holder 52 is movable in the vertical direction relative to the carriage 51 by a vertical movement mechanism (not shown). By controlling the operation of the vertical movement mechanism, the position in the vertical direction of the cutter 53 can be adjusted. A cutter can be detachably attached to a lower end of the cutter holder 52 and has a blade at its lower end for cutting the sheet-like medium M. The cutter 53 is supported by the cutter holder 52 such that the cutter 53 is rotatable in the normal and reverse directions about a rotary shaft which extends in the vertical direction. Connected to the cutting head 50 are electric wires or harnesses which extend from the main unit to transmit power and signals for controlling the operation of the aforementioned vertical movement mechanism, but not shown.

On the front surface of the cutting head 50, a spray unit 90 is disposed to apply coating agent for forming a coating layer on a surface of the sheet-like medium before the cutting process relative to the sheet-like medium.

The inkjet head 60 includes a carriage 61 which is attached to and movable along the guide rail 40 in the lateral direction, and a plurality of inkjet head modules 62 which are disposed on the lower end side of the carriage 61 and are aligned in the lateral direction. Each module 62 is provided with a number of ink ejection holes formed in its lower surface. The ink ejection holes of each module 62 face to the supporting surface 30*a* of the platen 30 in the vertical direction. As the sheet-like medium M is put on the platen 30, ink droplets are ejected from the ink ejection holes to the surface of the sheet-like medium M to conduct intended printing. Connected to the modules 62 are tubes for supplying inks to ink passages from the ink storage portions (not shown) of the cartridge type. Also connected to the modules 62 are electric wires or harnesses for supplying electric power and signals for controlling the ink ejection. The ink storage portions may be mounted on the body 10 or on the carriage 61.

Below a left end portion of the guide rail 40, the main unit (the body 10) is provided with a maintenance device 70. The maintenance device 70 includes a stage 70*a* which is movable in the vertical direction and an anti-drying member 71 mounted on the upper surface of the stage 70*a*. The anti-drying member 71 is made of fabric or sponge having moisturizing property. As the inkjet head 60 is moved to the left end portion of the guide rail 40, the stage is automatically moved upward so that the lower surface of the module 62 is covered by the anti-drying member 71 to close the ink ejection holes. As the ink ejection holes are closed, the inks around the ink ejection holes are blocked from being exposed to ambient air, thereby preventing the clogging of the ink ejection holes due to drying of inks and thus keeping the ink ejection performance. The maintenance device 70 also includes a wiper 72 for wiping off ink residues adhering to the lower surface of the module 62. The wiper 72 is movable in the anteroposterior direction. By the operation of the wiper 72, the areas around the ink ejection holes are cleaned, thereby keeping the ink ejection performance.

The aforementioned heads 50, 60 are moved along the guide rail 40 in the lateral direction to conduct intended cutting process and intended printing process. A head driving device 80 for moving the heads 50, 60 in the lateral direction is arranged in the body 10. The head driving device 80 includes driving and driven pulleys 81, 82 which are positioned above the left and right end portions of the guide rail 40, an electric motor 83 (for example, a stepping motor or a servomotor) for rotating the driving pulley 81, a band-like driving belt 84 which is wound around the pulleys 81 and 82 to extend therebetween, and a driving carriage 85 which is supported by the guide rail 40 and is connected to the driving belt 84. The driving belt 84 is a synchronous belt and the pulleys 81, 82 are both synchronous pulleys so as to prevent slippage of the belt. The driving belt 84 does not form a loop singly. The both ends of the driving belt 84 are connected to the driving carriage 85. Therefore, the driving belt 84 forms a loop with and via the driving carriage 85 and is arranged to extend between the pulleys 81 and 82 without slack. The driving belt 84 is arranged with its width direction extending in a vertical direction and extends in the lateral direction in parallel with the guide rail 40 above the guide rail 40 between the pulleys 81 and 82. In the head driving device 80 having the aforementioned structure, the lateral movement of the driving belt 84 is controlled by controlling the driving of the electric motor 83 to rotate the driving pulley 81.

The respective heads 50, 60 are supported by the guide rail 40 in the state not connected to the driving belt 84 such that the heads 50, 60 can freely move in the lateral direction independently from each other. To enable the respective heads 50, 60 to be controlled to independently move in the lateral direction, a cutting head connecting mechanism 110 for detachably connecting the cutting head 50 and the driving carriage 85 is disposed on the cutting head 50 and the driving carriage 85 and an inkjet head connecting mechanism 120 for detachably connecting the inkjet head 60 and the driving carriage 85 is disposed on the inkjet head 60 and the driving carriage 85. The head connected to the driving carriage 85 by the connecting mechanism 110, 120 is enabled to move in the lateral direction along the guide rail 40. The specific structure of these connecting mechanisms will be described in detail later.

As shown in FIG. 2, a right hook bracket 12*a* is fixed to the right side wall 11*a* of the body 10 in the printer-plotter. The right hook bracket 12*a* is provided with a right hook 131 which can pivotally move in the vertical direction by a built-in solenoid (not shown). On the other hand, the carriage 51 of the cutting head 50 is provided with an engaging portion which can be engaged with the right hook 131 when the carriage 51 moves along the guide rail 40 and reaches the right end portion 40*a*, but not shown. The right hook 131 is actuated by the built-in solenoid to engage with or disengage from the engaging portion when the cutting head 50 is positioned at the right end portion 40*a*. As the right hook 131 is engaged with the engaging portion of the cutting head 50. the cutting head 50 is fixed and held in a state supported by the right end portion 40*a* of the guide rail 40.

Similarly, a left hook bracket 12*b* is fixed to the left side wall 11*b* of the body 10. The left hook bracket 12*b* is provided with a left hook 141 which can pivotally move in the vertical direction by a built-in solenoid (not shown). On the other hand, the carriage 61 of the inkjet head 60 is provided with an engaging portion which can be engaged with the left hook 141 when the carriage 61 moves along the guide rail 40 and reaches the left end portion 40*b*, but not shown. The left hook 141 is actuated by the built-in solenoid to engage with or disengage from the engaging portion when the inkjet head 60 is positioned at the left end portion 40*b*. As the left hook 141 is engaged with the engaging portion of the inkjet head 60. the inkjet head 60 is fixed and held in a state supported by the left end portion 40*b* of the guide rail 40.

Hereinafter, the operation of conducting the cutting and printing processes relative to a sheet-like medium M using the printer-plotter P having the aforementioned structure. For conducting the cutting process relative to the sheet-like medium M using the cutting head 50, prior to the process, the inkjet head 60 is connected to the driving carriage 85 by the inkjet head connecting mechanism 120 and is thus moved leftward. As the inkjet head 60 reaches the left end portion 40*b*, the hook 141 is engaged with the engaging portion so that the inkjet head 60 is fixed and held at the left end of the guide rail 40. At the same time, the stage 70*a* of the maintenance device 70 is automatically moved upward so that the ink ejection holes are closed by the anti-drying member 71.

Then, the driving carriage 85 is moved rightward so as to cancel the connection between the inkjet head 60 and the driving carriage 85 and the cutting head 50 is connected to the driving carriage 85 by the cutting head connecting mechanism 110. In this manner, only the cutting head 50 as one of the two heads 50, 60 is enabled to move along the guide rail 40 in the lateral direction and the cutting head 50 is moved rightward and leftward together with the driving carriage 85 while feeding the medium M forward and backward by the feeding mechanism 20, whereby the cutter 53 is moved forward, backward, rightward, and leftward relative to the medium M to conduct the cutting process.

On the other hand, for conducting the printing process relative to the sheet-like medium M using the inkjet head 60, also prior to the process, the cutting head 50 is connected to the driving carriage 85 by the cutting head connecting mechanism 110 and is thus moved rightward. As the cutting head 50 reaches the right end portion 40*a*, the hook 131 is engaged with the engaging portion so that the cutting head 50 is fixed and held at the right end of the guide rail 40.

Then, the cutting head 50 is separated from the driving carriage 85 while the cutting head is fixed and held at the right end and then the driving carriage 85 is moved leftward. Then, the inkjet head 60 is connected to the driving carriage 85 by the inkjet head connecting mechanism. In this manner, only the inkjet head 60 as one of the two heads 50, 60 is enabled to move along the guide rail 40 in the lateral direction and ink droplets are ejected through the ink ejection holes of the modules 62 onto the surface of the sheet-like medium M put on the supporting surface 30*a* of the platen 30, thereby conducting intended printing. The carriage 61 of the inkjet head 60 is provided with a media width sensor 91 so as to detect the width and the supported position of the medium M. Based on the detected value of the media width sensor 91, the inkjet head 60 is controlled to eject ink droplets to suitable positions relative to the medium M.

After completion of the predetermined cutting and the printing processes as mentioned above, the sheet-like medium M is cut out by a separation cutter 92 which is attached to the carriage 61 of the inkjet head 60 such that the separation cutter 92 is movable in the vertical direction, thereby separating the sheet-like medium M into a printed portion and an unprinted portion. This action is achieved by moving the separation cutter 92 downward to a position capable of touching the sheet-like medium M and sweeping the inkjet head 60 in a lateral direction.

According to the printer-plotter P as mentioned above, the head not required for the action relative to the sheet-like medium M is never moved along the guide rail 40. Therefore, the capacity of the electric motor 83 for driving the heads 50, 60 can be smaller, thereby achieving the cost reduction. Since the cutting head 50 is on standby in a state fixed at the right end portion 40*a* of the guide rail 40 during the printing process using the inkjet head 60, there is no chance that the cutting head 50 gets closer to the inkjet head 60 so that ink droplets ejected from the inkjet head 60 never adhere to the cutting head 50 and the cutting head 50 is thus never contaminated. Moreover, there is no chance that parts mounted on the cutting head 50 such as the covers of harnesses or the like are dissolved due to the adhesion of the ink. Therefore, the requirement for selecting a material having ink resistance to produce these parts can be eliminated, thereby achieving both elimination of operation error and reduction of cost.

Hereinafter, the specific structure of the connecting mechanisms for respectively connecting the heads 50, 60 to the driving carriage 85 will be described with reference to FIG. 2 and FIG. 4 through FIG. 13. FIG. 2 shows the cutting head connecting mechanism and the inkjet head connecting mechanism of the first structural example. These connecting mechanisms 110, 120 are composed of permanent magnets 111, 121 which are fixed to the both side walls of the driving carriage 85. The carriages 51, 61 of the cutting head 50 and the inkjet head 60 are formed from metallic sheet members having magnetism.

The action of the cutting head connecting mechanism 110 will be described. As the driving carriage 85 gets closer to the cutting head 50, the driving carriage 85 and the carriage 51 are fixate to each other by attraction force generated between the permanent magnet 111 and the carriage 51 of the cutting head 50. By moving the driving carriage 85 leftward when the cutting head 50 is fixed by the hook 131, the permanent magnet 111 is separated from the carriage 51 of the cutting head 50 against the attraction force so as to allow the driving carriage 85 to move leftward along the guide rail 40. The same is true for the action of the inkjet head connecting mechanism 120. It should be noted that the magnets are not limited to the permanent magnets and may be electromagnets.

FIG. 4 and FIGS. 5A-5D show an example in which a connecting mechanism of a second structural example is applied to the inkjet head connecting mechanism 120. The connecting mechanism is structured to have also a mechanism for fixing the inkjet head 60 to the guide rail 40 so that the left-side hook 141 shown in FIG. 2 is omitted. The connecting mechanism includes a cylindrical pole member 221 extending in the vertical direction which is disposed on the carriage 61 via a bracket extending forward from the carriage 61 of the inkjet head 60, and receiving portions 225, 240 which are disposed on the left side wall of the driving carriage 85 and the left side wall of the body 10, respectively and can be engaged with the pole member 221. The driving-side receiving portion 225 is a combination of a fixing member 226 and a swinging member 227 which are formed in L-like shapes and cooperate together to form a concavity 225*a* which is U-like shape in plan view of which opening faces to the pole member 221. The swinging member 227 is biased by a biasing member in a direction of closing the opening. The body-side receiving portion 240 is a combination of an L-like member 241 which is fixed to a bracket connected to the body 10 and a swinging member 242 which is pivotally connected to the L-like member 241. The L-like member 241 and the swinging member 242 cooperate together to form a concavity 240*a* which is U-like shape in plan view of which opening faces to the pole member 221. The swinging member 242 is biased by a biasing member in a direction of closing the opening.

In this structural example, by moving the driving carriage 85 leftward from a state where the pole member 211 is engaged in the concavity 240*a* of the body-side receiving portion 240 (see FIG. 5A), the swinging member 227 of the driving-side receiving portion 225 enters into the concavity 240*a* of the body-side receiving portion 240 because the opening rate of the driving-side receiving portion 225 is reduced by the biased swinging member 227 and is thus smaller than the opening rate of the body-side receiving portion 240. Accordingly, the pole member 211 is caught by the driving-side receiving portion 225 (see FIG. 5B). By moving the driving carriage 85 rightward from this state, the pole member 211 is engaged with the driving-side receiving portion 225 so that the inkjet head 60 is moved rightward together with the driving carriage 85 (see FIG. 5C). By moving the driving carriage 85 to the left end portion in the state where the inkjet head 60 is connected to the driving carriage 85 as mentioned above, the swinging member 242 of the body-side receiving portion 240 enters into the concavity 225*a* of the driving-side receiving portion 225 because the opening rate of the body-side receiving portion 240 is reduced by the biased swinging member 242 and is thus smaller than the opening rate of the driving-side receiving portion 225. Accordingly, the pole member 211 is caught by the body-side receiving portion 240 (see FIG. 5D). By moving the driving carriage 85 rightward from this state, the inkjet head 60 is separated from the driving carriage 85 and the inkjet head 60 is fixed and held at the left end of the guide rail 40.

Figure 6:
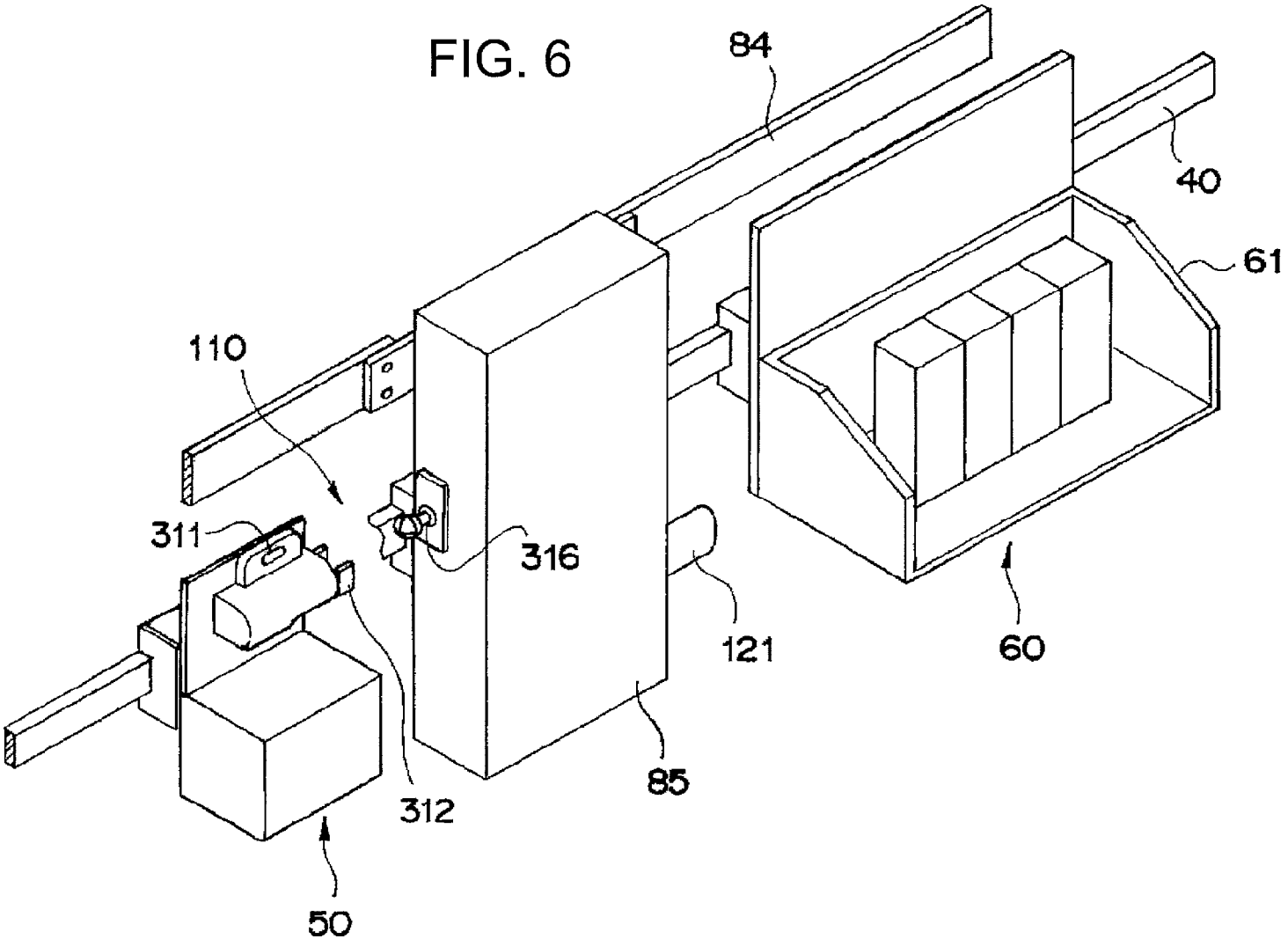
FIG. 6 is a perspective view showing a connecting mechanism of a printer-plotter according to another embodiment of the present invention.

FIG. 6 shows an example in which a connecting mechanism of a third structural example is applied to the cutting head connecting mechanism 110. The cutting head connecting mechanism 110 is a conventionally known push latch. That is, the cutting head connecting mechanism 110 includes a casing 311 having claws 312 projecting outward which extend from the holes to increase the distance therebetween, and a striker 316 which is formed in a substantially spherical shape. The casing 311 is fixed to the carriage 51 of the cutting head 50 and the striker 316 is fixed to the driving carriage 85.

In this structural example, as the driving carriage 85 is moved rightward to bring the striker 316 into contact with the claws 312, the claws 312 are retracted into the casing 311 and stopped. At the same time, the striker 316 is caught by the claws 312. Therefore, the driving carriage 85 and the cutting head 50 are connected to each other. On the other hand, as the driving carriage 85 is moved rightward once so that the striker 316 acts a force of moving the claws 312 into the casing 311 when the cutting head 50 connected to the driving carriage 85 is fixed by the hook 131, the claws 312 is cancelled from the state stopped inside the casing 311 to project out of the casing 311. Accordingly, the striker 316 is released from the claws 312 so that the driving carriage 85 and the cutting head 50 are separated from each other.

Figure 7:
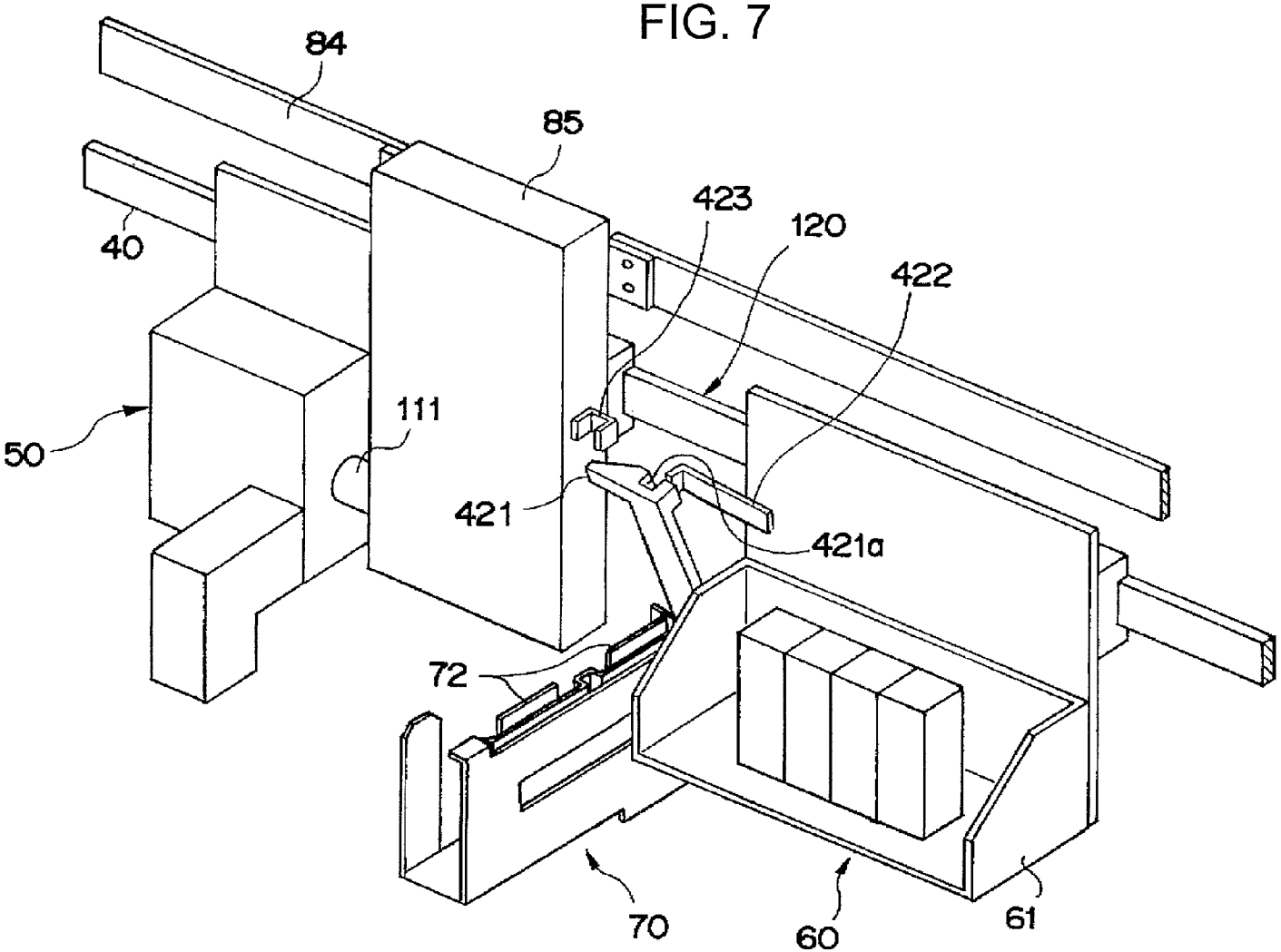
FIG. 7 is a perspective view showing a connecting mechanism of a printer-plotter according to another embodiment of the present invention.

FIG. 7 shows an example in which a connecting mechanism of a fourth structural example is applied to the inkjet head connecting mechanism 120. Since this structural example is an arrangement utilizing the forward and backward movement of the wiper 72 of the maintenance device 70, it is suitable to be applied especially to the inkjet head connecting mechanism 120. The connecting mechanism 120 includes a pivot arm 421 which is attached to the right side wall of the carriage 61 of the inkjet head 60 such that the pivot arm 421 is pivotally movable in the anteroposterior direction, a head-side engaging arm 422 which projects rightward from the right side wall of the carriage 61 of the inkjet head 60 and of which distal end is bent forward, a driving-side engaging arm 423 which project leftward from the driving carriage 85 and of which distal end is belt forward, and a biasing member (not shown) for biasing the pivot arm 421 to stand vertically. The pivot arm 421 is provided with a concavity 421*a* which is formed by cutting out a portion in a back side of a distal end portion of the pivot arm 421. When the pivot arm 421 stands vertically, the end of the head-side engaging arm 422 is fit in a left-side half of the concavity 421*a*.

In this structural example, as the wiper 72 of the maintenance device 70 is moved backward when the inkjet head 60 is connected to the body 10, a proximal end portion of the pivot arm 421 is pressed by the wiper 72 so that the distal end portion of the pivot arm 421 tilts forward against the biasing force of the biasing member. By moving the driving carriage 85 leftward from this state, to bring the ends of the two engaging arms 422, 423 into contact with each other in the lateral direction and moving the wiper 72 forward to stand the pivot arm 421, the ends of the engaging arms 422, 423 are fit and accommodated into the concavity 421*a* of the pivot arm 421 so that the driving carriage 85 and the inkjet head 60 are connected to each other. On the other hand, by moving the inkjet head 60 in the connected state to the left end portion of the guide rail 40 and moving the wiper 72 backward, the connection between the pivot arm 421 and the two engaging arms 422, 423 is cancelled so that the inkjet head 60 is separated from the driving carriage 85.

Figure 8:
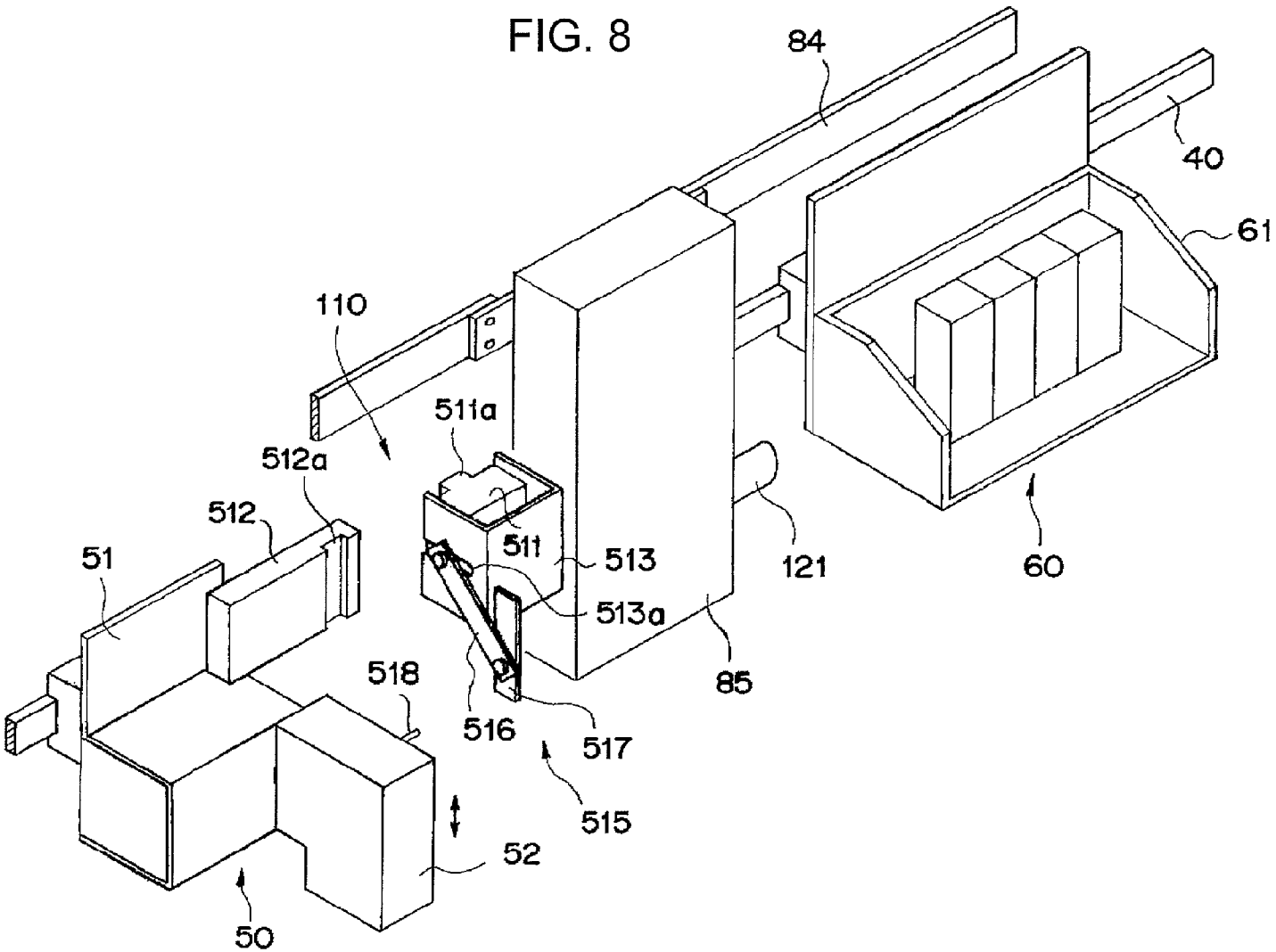
FIG. 8 is a perspective view showing a connecting mechanism of a printer-plotter according to another embodiment of the present invention.
Figure 9:
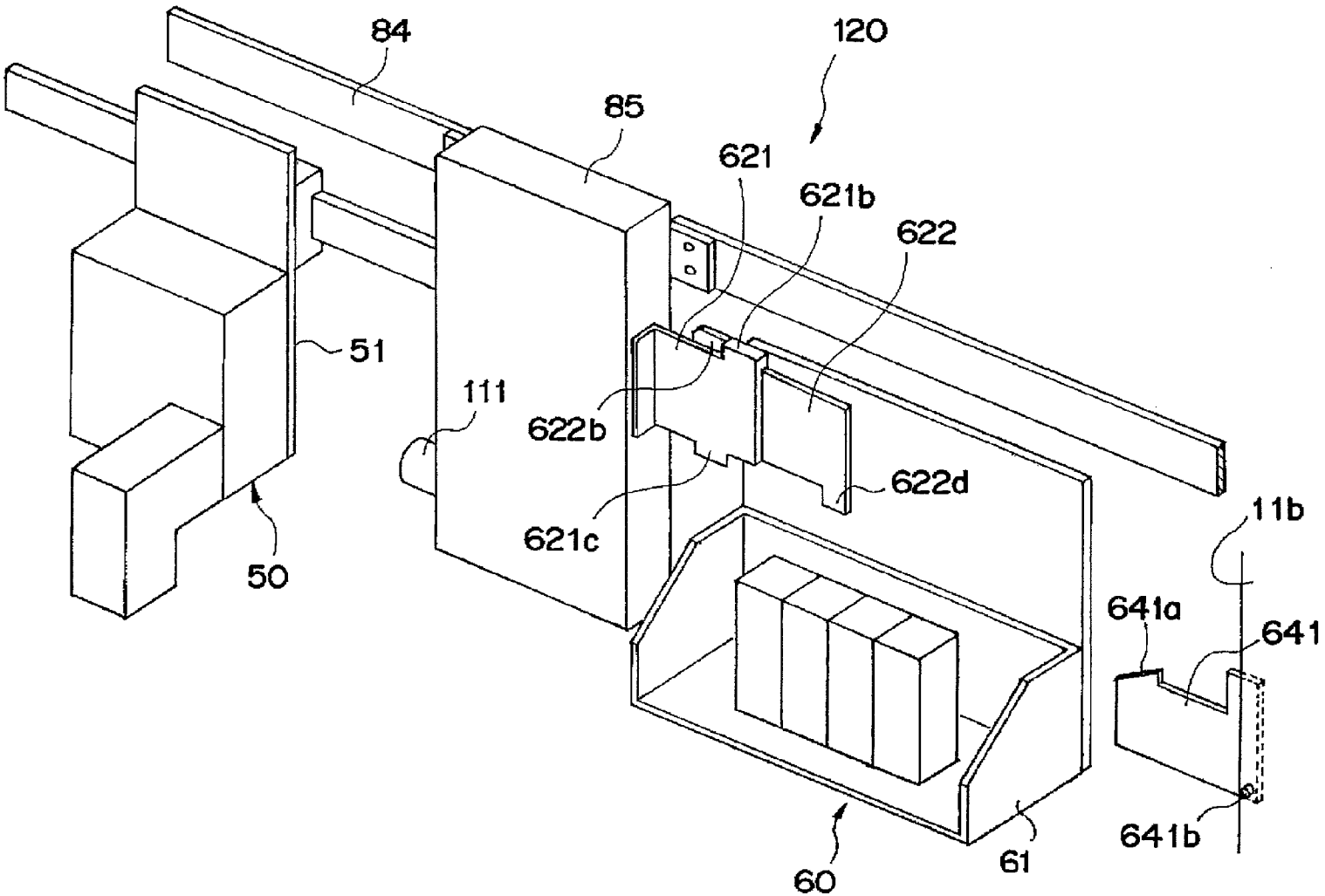
FIG. 9 is a perspective view showing a connecting mechanism of a printer-plotter according to another embodiment of the present invention.

FIG. 8 shows an example in which a connecting mechanism of a fifth structural example is applied to the cutting head connecting mechanism 110. The cutting head connecting mechanism 110 of the structural example includes an engaging member 511 which is attached to the right side wall of the driving carriage 85 such that the engaging member 511 is movable in the anteroposterior direction, a receiving plate 512 which projects leftward from the left side wall of the carriage 51 of the cutting head 50, and a moving mechanism 515 for moving the engaging member 511 in the anteroposterior direction. The engaging member 511 is formed in a substantially rectangular parallelepiped, is provided with a convexity 511*a* projecting backward from a middle portion in the lateral direction of the rear surface wall, and is accommodated in a housing bracket 513 which is formed in a U-like shape in plan view. The housing bracket 513 is connected to the right side wall of the driving carriage 85. The housing bracket 513 is provided with slits which are formed in the right and left side walls of the housing bracket 513 to extend in the anteroposterior direction. The engaging member 511 has pins projecting from the right and left side walls of the engaging member 511. The pins of the engaging member 511 fit in the slit 513*a*, respectively so that the engaging member 511 can be guided by the slits 513*a* to slide in the anteroposterior direction within a space surrounded by the walls of the housing bracket 513. On the other hand, the receiving plate 512 has a plate shape and a concavity 512*a* which is formed in a front surface of the receiving plate 512 to extend in the vertical direction. The moving mechanism 515 includes a pivot arm 516 of which distal end is pivotally fixed by a pin of the engaging member 511, and a vertical movement arm 517 which is pivotally fixed to a proximal end of the pivot arm 516 and is guided to move vertically. The cutter holder 52 is provided with a pin 518 projecting leftward from the cutting head 50.

In this structural example, by moving the driving carriage 85 rightward when the cutting head 50 is connected to the body 10, the pin 518 of the cutter holder 52 is inserted into a through hole formed in the vertical movement arm 517 and the convexity 511*a* of the engaging portion 511 and the concavity 512*a* of the receiving plate 512 are positioned to face each other in the anteroposterior direction. By moving the cutter holder 52 upward so as to move the vertical movement arm 517 upward, the distal end of the pivot arm 516 is moved backward so as to move the engaging member 511 backward within the space surrounded by the side walls of the housing bracket 513. Accordingly, the convexity 511*a* of the engaging member 511 and the concavity 512*a* of the receiving plate 512 are engaged with each other, whereby the driving carriage 85 and the cutting head 50 are connected to each other. On the other hand, by moving the cutter holder 52 downward to move the vertical movement arm 517 downward, the distal end of the pivot arm 516 is moved forward. Accordingly, the engaging member 511 is moved forward within the aforementioned space, whereby the engagement between the engaging member 511 and the receiving plate 512 is cancelled. As the driving carriage 85 is moved leftward, the pin 518 of the cutter holder 52 comes off from the through hole of the vertical movement arm 517 so that the driving carriage 85 and the cutting head 50 are separated from each other.

FIG. 9 and FIGS. 10A-10D show an example in which a connecting mechanism of a sixth structural example is applied to the inkjet head connecting mechanism 120. The connecting mechanism is structured to have also a mechanism for fixing the inkjet head to the guide rail 40 so that the hook 141 shown in FIG. 2 is omitted. The connecting mechanism includes an engaging plate 621 which is fixed to the left side wall of the driving carriage 85, a pivot plate 622 which is pivotally fixed to a back plate of the carriage 61 of the inkjet head 60, and a body-side plate 641 which is pivotally fixed to the left side wall 11*b* of the body 10.

The engaging plate 621 is provided with a pin 621*a* projecting backward from the back of a left edge portion thereof. The engaging plate 621 is also provided with engaging ribs 621*b*, 621*c* projecting from an upper edge and a lower edge thereof, respectively. The pivot plate 622 is provided with a stepped groove 622*a* formed in a right edge portion. The pivot plate 622 is also provided with engaging ribs 622*b*, 622*c* projecting from an upper edge and a lower edge thereof, respectively, and with an ancyroid hook 622*d* which is formed on a left end portion of the lower edge thereof. The body-side plate 641 is provided with a hook receiving portion 641*a* for receiving the hook 622*d*. The body-side plate 641 is pivotally movable about a pivot pin 641*b* which is formed on a lower left corner thereof and is always biased in the counter-clockwise direction.

Figure 10A:
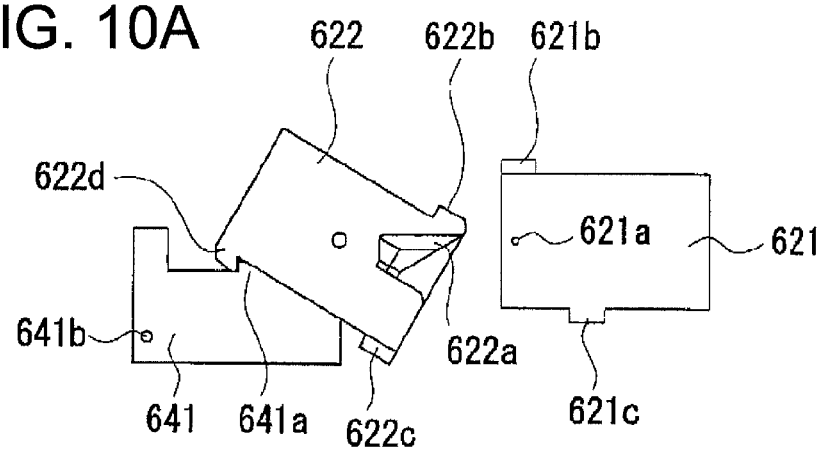
FIGS. 10A-10D schematically show the structure and actions of main parts of the connecting mechanism as shown in FIG. 9, FIG. 10A showing a state where a pivot plate and a body-side plate are connected to each other and the pivot plate and an engaging plate are separated from each other, FIG. 10B showing a state where the pivot plate and the engaging plate start to connect to each other, FIG. 10C showing a state where the pivot plate and the engaging plate are connected to each other and pivot plate and the body-side plate start to separate from each other, and FIG. 10D showing where the pivot plate and the body-side plate start to connect to each other.
Figure 10B:
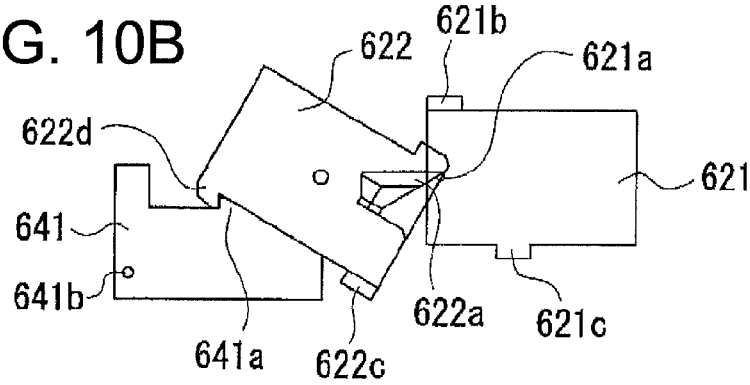
Figure 10C:
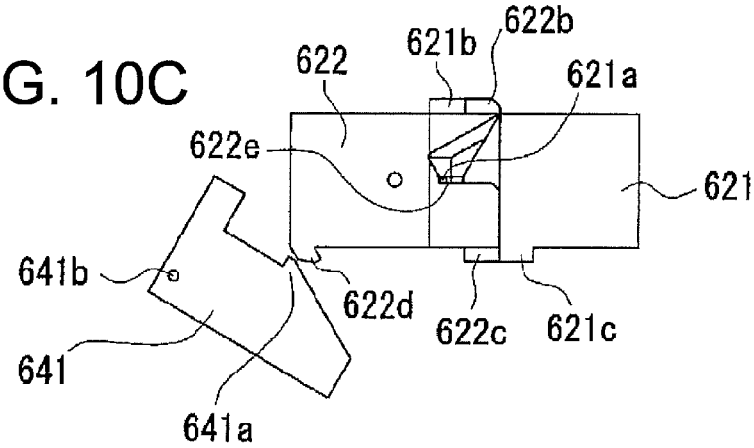
Figure 10D:
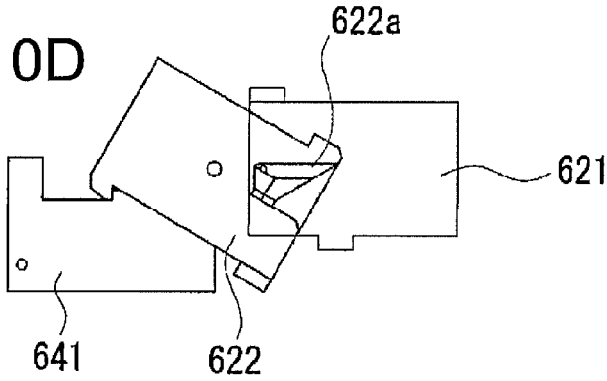

In this structural example, as shown in FIG. 10A, by engaging the hook 622*d* of the pivot plate 622 with the hook receiving portion 641*a* of the body-side plate 641, the inkjet head 60 and the body 10 are connected to each other. In this state, the body-side plate 641 is biased by a compression spring so that the pivot plate 622 is in a state rotated in the clockwise direction. To separate the inkjet head 60 from the body 10 and connect the inkjet head 60 to the driving carriage 85 from this state, the driving carriage 85 is moved leftward so as to bring the pin 621*a* of the engaging plate 621 to enter into the groove 622*a* of the pivot plate 622. Since there is a plate spring at the entrance of the groove 622*a*, the pin 621*a* enters obliquely downward into the groove 622*a*. By further moving the driving carriage 85 leftward so that the pin 621*a* further enters into the groove 622*a*, the pivot plate 622 is rotated in the counter-clockwise direction. According to this rotation, the body-side plate 641 is rotated in the clockwise direction against the biasing force of the compression spring, whereby the engagement between the pivot plate 622 and the body-side plate 641 is cancelled. The engaging ribs 621*b*, 621*c* of the engaging plate 621 are engaged with the engaging ribs 622*b*, 622*c* of the pivot plate 622 and the pin 621*a* is received in a pin receiving portion 622*e* of the groove 622*a*. Since the pin receiving portion 622*e* has a different level from the passage just before the pin receiving portion 622*e*, the engagement between the engaging plate 621 and the pivot plate 622 is prevented from being cancelled even if the driving carriage 85 is moved rightward when the pin 621 is received by the pin receiving portion 622*e*. On the other hand, to separate the inkjet head 60 from the driving carriage 85 and connect the inkjet head 60 to the body 10, the driving carriage 85 is moved leftward together with the inkjet head 60 so as to bring the pivot plate 622 into contact with the body-side plate 621, thereby rotating the pivot plate 622. Thus, the hook 622*d* and the hook receiving portion 641*a* are engaged with each other. According to the rotation of the pivot plate 622, the engagement between the engaging ribs 621*b*, 621*c* and the engaging ribs 622*b*, 622*c* is cancelled and the pin 621*a* comes off from the pin receiving portion 622*e* in the groove 622*a*. As the driving carriage 85 is moved rightward from this state, the driving carriage 85 is moved alone rightward along the guide rail 40.

Figure 11:
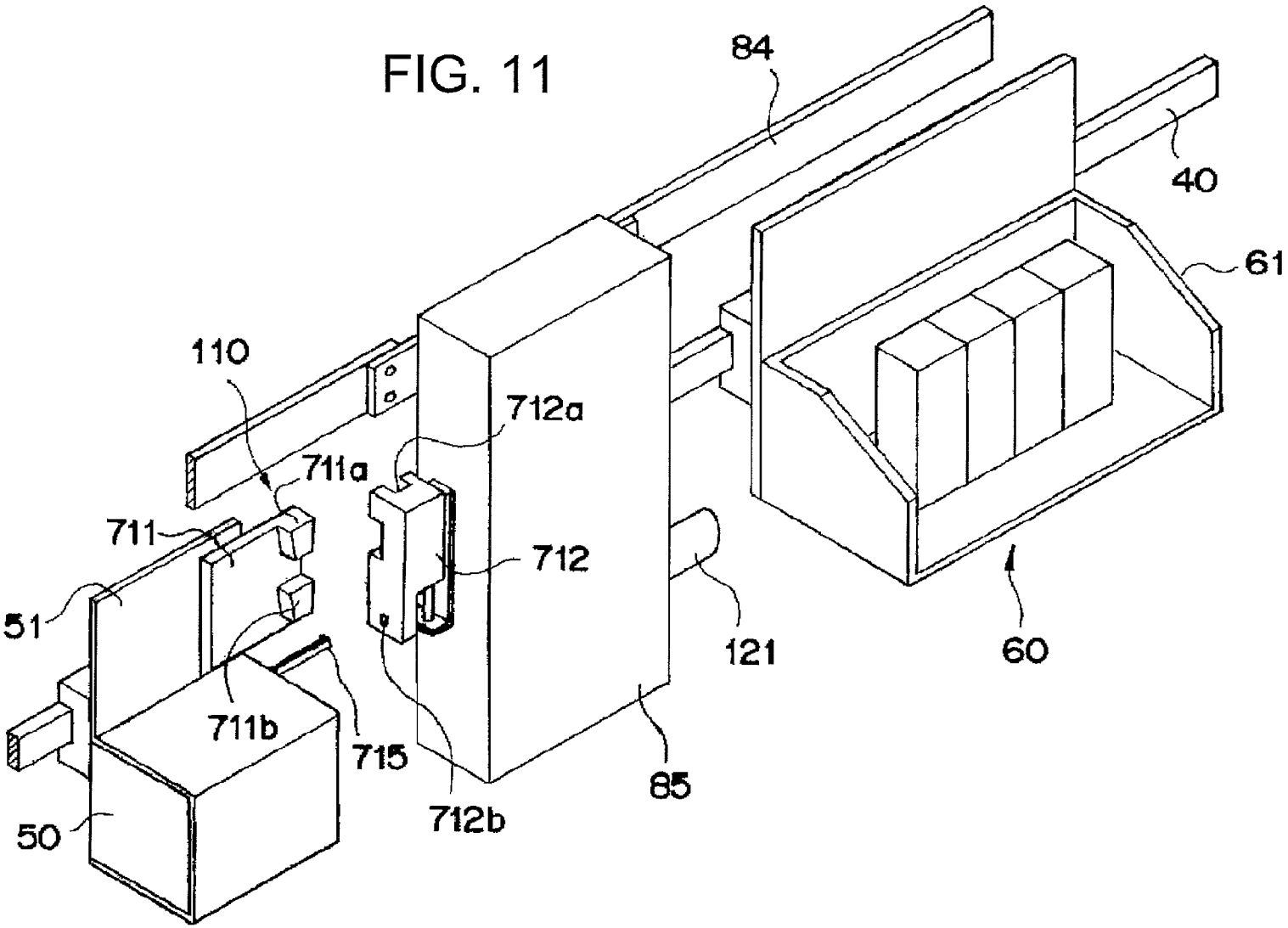
FIG. 11 is a perspective view showing a connecting mechanism of a printer-plotter according to another embodiment of the present invention.

FIG. 11 shows an example in which a connecting mechanism of a seventh structural example is applied to the cutting head connecting mechanism 110. The cutting head connecting mechanism 110 includes an engaging plate 711 which is connected to the driving carriage 85, a receiving member 712 which is attached to the driving carriage 85 such that the receiving member 712 is movable in the vertical direction, and a biasing member for biasing the receiving member 712 upward. The engaging plate 711 is provided with two convexities 711*a*, 711*b* which are vertically aligned to project forward. On the other hand, the receiving member 712 is formed in a U-like shape in plan view of which concavity-type opening opens backward. The carriage 51 of the cutting head 50 is provided with a pin 715 projecting leftward. The pin 715 is moved upward when energized by a solenoid device (not shown).

In this structural example, by moving the driving carriage 85 rightward, the pin 715 is inserted into a through hole 712*b* formed in the receiving member 712. By moving the pin 715 downward by the electromagnetic actuation of the solenoid device, the receiving member 712 is moved downward. The driving carriage 85 is further moved rightward. Accordingly, the upper convexity 711*a* formed on the engaging plate 711 is positioned above relative to the receiving member 712 and the lower convexity 711*b* is fit in a cutout portion 712*c* formed in the side wall of the receiving member 712. By moving the pin 715 upward by the electromagnetic actuation of the solenoid device to move the receiving member 712 upward, the upper and lower convexities 711*a*, 711*b* of the engaging plate 711 are fit in a space surrounded by the side walls of the receiving member 712. Therefore, the cutting head 50 and the driving carriage 85 are connected to each other. On the other hand, to separate the driving carriage 85 and the cutting head 50 from each other, the pin 715 is moved downward by the electromagnetic actuation of the solenoid device so as to move the receiving member 712 downward. Accordingly, the upper and lower concavities 711*a*, 711*b* of the engaging plate 711 are released from the space surrounded by the side walls. As the driving carriage 85 is moved leftward from this state, the engagement between the engaging plate 711 and the receiving member 712 is cancelled and the pin 715 comes off from the through hole 712*b* of the receiving member 712 so that the driving carriage 85 and the cutting head 50 are separate from each other. Thus, the driving carriage 85 is moved alone leftward along the guide rail 40.

Figure 12:
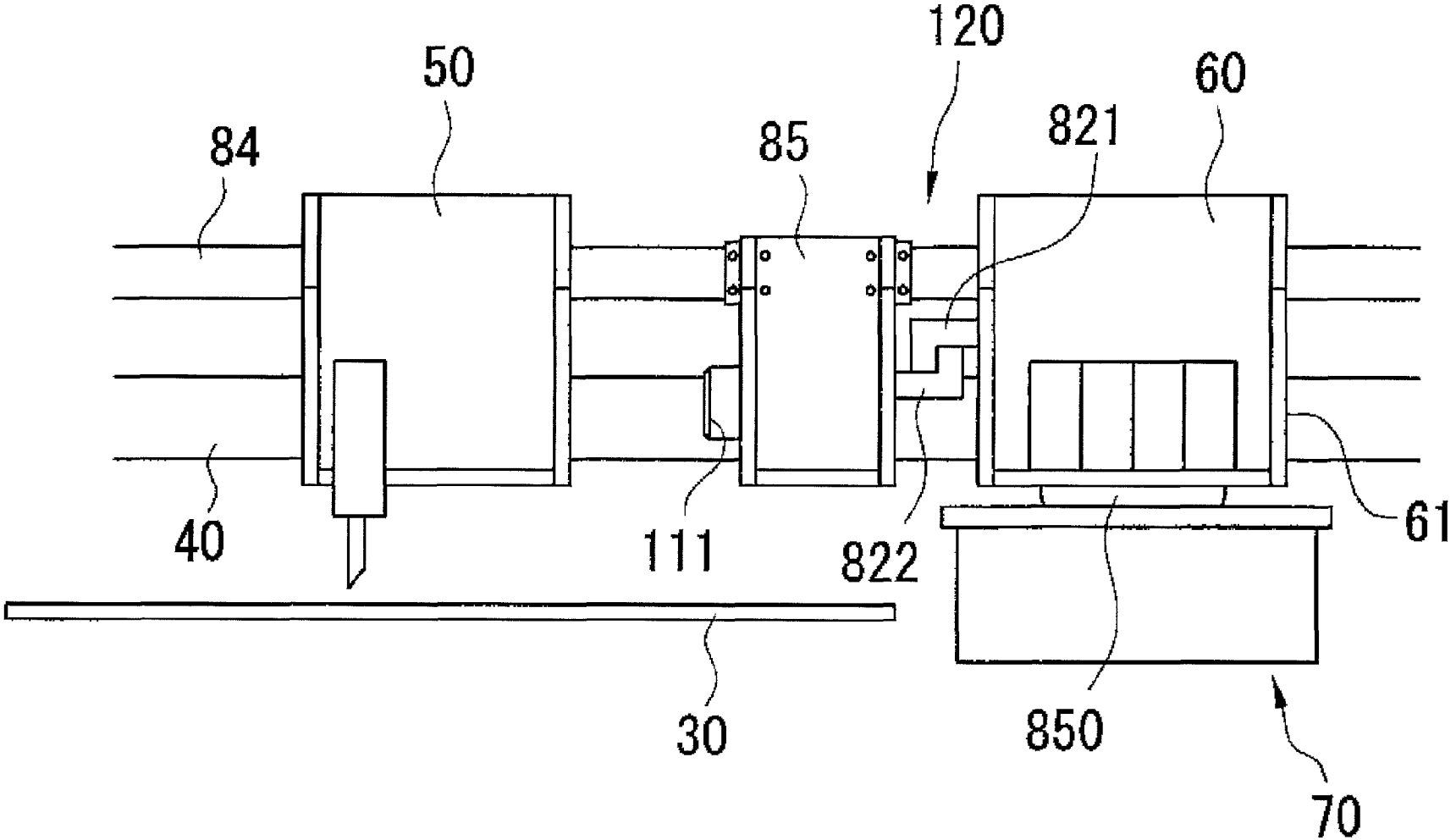
FIG. 12 is a perspective view showing a connecting mechanism of a printer-plotter according to another embodiment of the present invention.

FIG. 12 shows an example in which a connecting mechanism of an eighth structural example is applied to the inkjet head connecting mechanism 120. The connecting mechanism includes a head-side hook 821 projecting rightward from the right side wall of the carriage 61 of the inkjet head 60, and a driving-side hook 822 projecting leftward from the left side wall of the driving carriage 85. In this structural example, the carriage 61 of the inkjet head 60 is movable in the vertical direction and is always set at the lowest position within the vertical movable range because of its own weight.

In this structural example, to connect the driving carriage 85 and the inkjet head 60 to each other, the carriage 61 of the inkjet head 60 is jacked up by a jack 850 previously mounted on the maintenance device 70. The driving carriage 85 is moved leftward to a predetermined position and the jack 850 is driven to move the carriage 61 of the inkjet head 60 downward to the lowest position within the vertical movable range. Accordingly, the head-side hook 821 is engaged with the driving-side hook 822 so that the driving carriage 85 and the inkjet head 60 are connected to each other. On the other hand, to separate the inkjet head 60 and the driving carriage 85 from each other, the driving carriage 85 is moved leftward to move the inkjet head 60 to a position above the maintenance device 70. The, the carriage 61 of the inkjet head 60 is jacked up by the actuation of the jack 850. Accordingly, the engagement between the driving-side hook 822 and the head-side hook 821 is cancelled.

Figure 13:
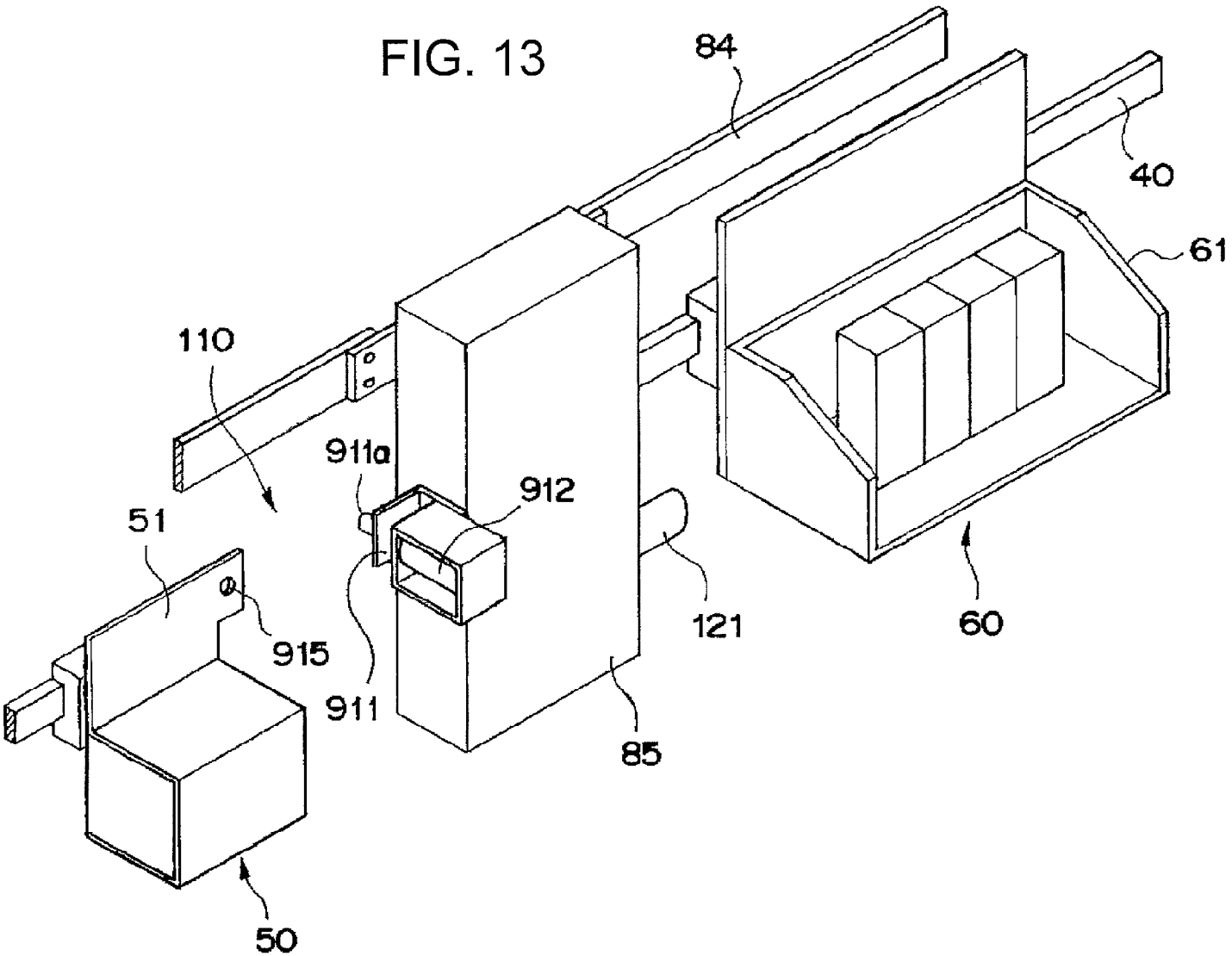
FIG. 13 is a front view showing a connecting mechanism of a printer-plotter according to another embodiment of the present invention.

FIG. 13 shows an example in which a connecting mechanism of a ninth structural example is applied to the cutting head connecting mechanism 110. The cutting head connecting mechanism 110 includes a plate 911 which is attached to the driving carriage and is provided with a pin 911*a* projecting backward, a solenoid device 912 which extrudes a plunger to push the plate 911 backward when excited, and a biasing member for biasing the plate 911 forward. The carriage 51 of the cutting head is provided with a through hole 915 of which diameter is substantially the same as the diameter of the pin 911.

In this structural example, as the driving carriage 85 is moved rightward to a position at a predetermined distance from the cutting head 50, the solenoid device 912 is excited so as to extrude the plunger backward so that the plate 911 is pushed to move backward against the biasing force of the biasing member. Accordingly, the pin 911*a* is inserted into the aforementioned through hole 915, whereby the driving carriage 85 and the cutting head 50 are connected to each other. As the solenoid device is demagnetized, the plunger is retracted and the plate 911 is retracted forward because of the biasing force of the biasing member. Then, the plate 911 is kept in a state being contact with the plunger. Accordingly, the pin 911*a* comes off from the through hole 915 so that the cutting head 50 and the driving carriage 85 are separated from each other.

Though the printer-plotter according to the embodiment of the present invention has been described with the aforementioned embodiments, the scope of the present invention is not limited to the aforementioned structures. As will be described below, the combination of two head supported by the guide rail 40, the structure of the head driving device 80, the structure for moving the heads 50, 60 in the anteroposterior direction and the lateral direction relative to the sheet-like medium M may be suitably modified. In the following description, the same components as those of the aforementioned structural examples will be marked by the same numerals so as to omit redundant description.

The combination of heads may be a combination of two inkjet heads for ejecting ink droplets of different compositions or different colors, for example, an aqueous inkjet head for ejecting aqueous ink droplets and a solvent inkjet head for ejecting solvent ink droplets.

In this variation example, while one of the heads is used to conduct printing, the other head is positioned at an end of the guide rail 40 and is on standby in a state where the ink ejection holes are closed. Therefore, the capacity of the electric motor 83 for can be smaller and there is no chance that ink droplets ejected from one of the inkjet heads adhere to the other inkjet head. It should be noted that each conventional apparatus is provided with only one inkjet head even when printing with inks of different properties such as aqueous ink and solvent ink is needed because it is impossible to share tubes and a maintenance device. In this structural example, since two inkjet heads can be mounted, reduction in installation space and cost can be achieved as compared to the case where separate printer-plotters should be installed according to the ink compositions.

In this variation example, the combination of inks to be ejected from two inkjet heads is not limited to the combination of aqueous ink and solvent ink. One of the heads may eject UV curable ink. In this case, a light source device such as a halogen lamp for irradiating ultraviolet light to the sheet-like medium M is attached to one of the right and left side walls of the carriage of the inkjet head via a bracket.

Instead of the cutting head 50, a preprocessing head or a post-processing head may be provided. The preprocessing head is a head for conducting pretreatment for obtaining excellent printing result by ejecting a predetermined processing liquid relative to a sheet-like medium M such as fabric prior to the printing to ensure the permeability and fix level similar to the level of a sheet-like medium M which is manufactured for printing purpose. The post-processing head is a head for conducting coating process on a printed surface by ejecting a predetermined processing liquid relative to a sheet-like medium M after printing to improve the rub resistance and weatherability. The carriage of each head is provided with a spraying device having nozzles for ejecting the processing liquid such that the nozzles are arranged to face to the supporting surface 30*a* in the vertical direction. To use the head for the processing, the head is connected to the driving carriage, the inkjet head is connected to the body, and the ink ejection holes are closed. By ejecting the processing liquid from the nozzles while moving the nozzles in the anteroposterior and lateral directions relative to the sheet-like medium, whereby the processing liquid is sprayed on a predetermined area of the sheet-like medium M.

In this variation example, since treatment before or after the printing can be conducted in addition to the function as an inkjet printer, reduction in installation space and cost can be achieved as compared to a case where a separate apparatus capable of conducting such treatment is installed. Moreover, the treatment and the printing can be successively conducted automatically singly by this apparatus, thereby leading to significant laborsaving.

Instead of the cutting head 50, a scanner head for reading images and characters recorded or printed on a sheet-like medium may be provided. The carriage of the scanner head is provided with a scanner on which an image sensor having optical conversion elements is mounted for reading images and characters. To use the scanner head for the image reading, the carriage of the scanner head is connected to the driving carriage, the inkjet head is connected to the body, and the ink ejection holes are closed. By repeating an action of feeding the sheet-like medium forward a predetermined length by the feeding mechanism 20 and an action of reading an image or the like per a predetermined pixel width by the image sensor while moving the carriage of the scanner head once in the lateral direction, the image or the like in the predetermined area of the sheet-like medium M can be read out.

The data of the image thus read out can be used to conduct printing using the inkjet head. Alternatively, the scanner head may be used to read out image relative to a portion printed by the inkjet head. Then, the data for printing and the data of the image read out are compared to check the printing accuracy. Further, the result of checking of the printing accuracy may be displayed on an operation panel to prompt a user to carry out suitable maintenance operation.

In the variation example, the action of reading image or the like and the action of printing can be successively conducted automatically singly by this apparatus, thereby leading to significant laborsaving as compared to a case that a scanner and a printer are separately placed or a case that a scanner is structured as a cartridge type which can be replaced with a head module.

Further, a writing thing such as a pen may be held by the cutter holder of the cutting head in any of the aforementioned structural example. In this case, the printer has a function as a pen plotter. The cutter and the writing thing may be detachably attached to the cutter holder. Alternatively, one of the heads is an inkjet head and the other head is structured such that two or more of the followings, that is, a cutter holder, a spraying device for ejecting processing liquid, and a scanner may be detachably attached to the carriage. Therefore, it is possible to provide a printer-plotter having multiple functions. In any of the structural examples, the locations of the heads in the lateral direction may be exchanged. Also in this case, the same effects can be obtained. If the inkjet head is located at a right side, the maintenance device is positioned below a right end portion of the guide rail 40.

The head driving device 80 may be of any structure capable of transmitting driving force to the driving carriage supported by the guide rail 40 for moving along the guide rail in the lateral direction. For example, the head driving device 80 includes a pair of right and left pulleys each having a groove which is formed in the outer periphery to extend in the circumferential direction and a steel wire which is wound around the pulleys to extend therebetween with some tension not to slip.

Figure 14:
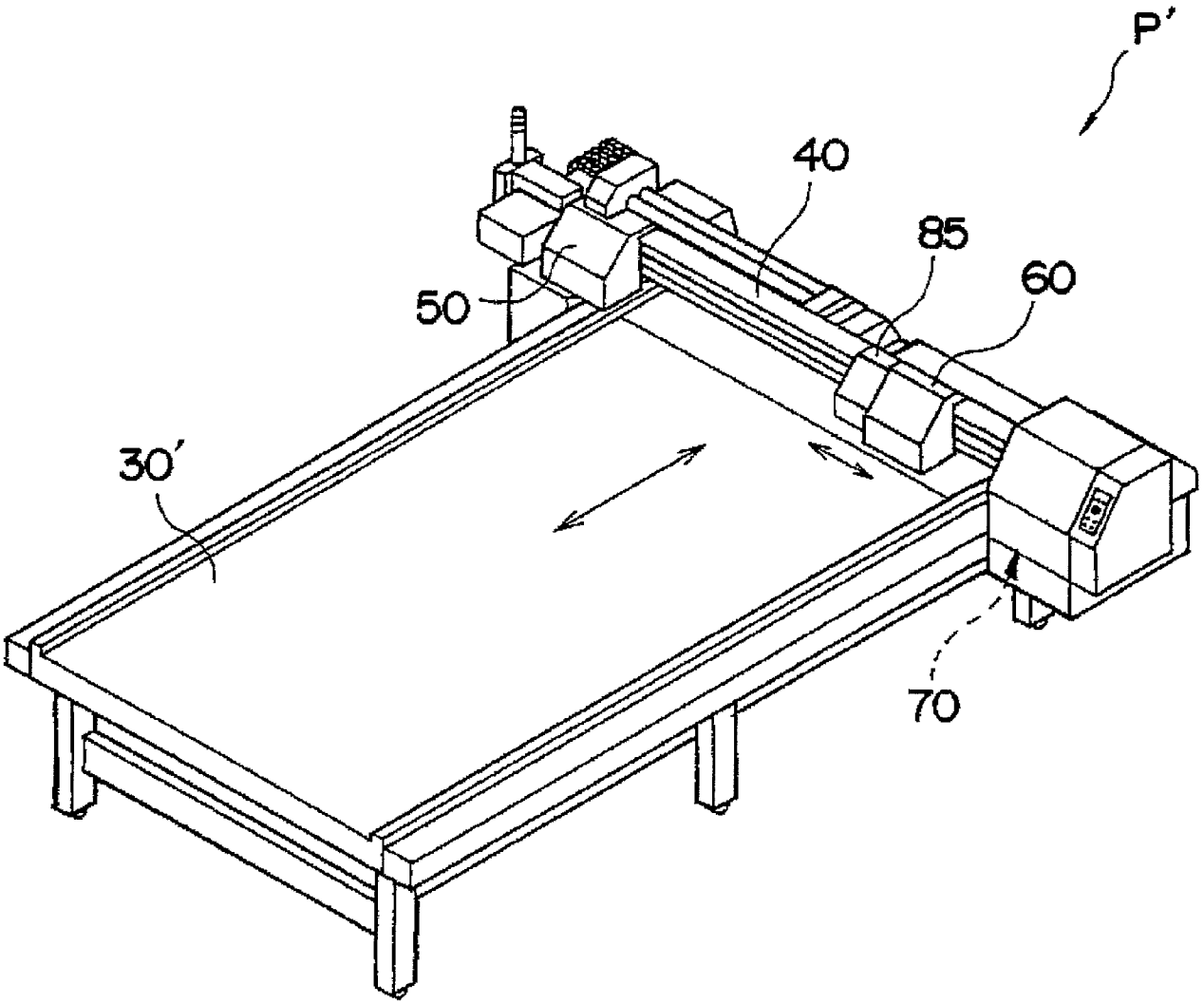
FIG. 14 is a perspective view showing a printer-plotter according to another embodiment of the present invention.

The arrangement for moving the head in the anteroposterior and lateral directions relative to the sheet-like medium may be an arrangement, as shown in FIG. 14, including a supporting table 30' which is fixed to a floor and supports a sheet-like medium placed thereon and a guide rail 40 which is disposed above the supporting table 30' to extend in the width direction, wherein the guide rail 40 is movable in the longitudinal direction of the supporting table 30' and the heads 50, 60 are movable in the anteroposterior and lateral directions relative to the sheet-like medium put on the supporting table 30'. This arrangement enables to handle a medium having large thickness. Alternatively, the guide rail may be fixed to the longitudinal direction of the supporting table and the supporting table may be movable in the longitudinal direction. This arrangement enables to handle a fabric as a sheet-like medium.

In the printer-plotter according to the embodiments of the present invention having the aforementioned structure, for example, as the driving member is moved in a state where the first head is connected to the driving member by the first connecting mechanism and the second head is separated from the driving member by the second connecting mechanism, the predetermined action can be conducted relative to the sheet-like medium by the first head while moving the first head in the lateral direction. During this, the second head is on standby in a state supported by the guide rail. On the other hand, the first head can be separated to be on standby and the second head can be connected to the driving member to conduct the predetermined action while moving in the lateral direction. As mentioned above, since the printer-plotter is structured such that the first and second heads are moved separately to conduct the respective actions relative to the sheet-like medium, the driving force required for the driving mechanism can be small and the driving device can be configured to be small and light, thereby achieving reduction in size, weight, and cost of the entire apparatus.

Since the first head is adapted to be fixed and held by the first head fixing mechanism and the second head is adapted to be fixed and held by the second head fixing mechanism, the second head is fixed and held at the end of the guide rail and thus never disturbs the action of the first head when the first head is moved along the guide rail in the lateral direction to conduct the predetermined action, and on the other hand, the first head is fixed and held at the end of the guide rail and thus never disturbs the action of the second head when the second head is moved along the guide rail in the lateral direction to conduct the predetermined action.

When the first head is a cutting head and the second head is an inkjet head, a small-sized printer-plotter can be provided which has both a function as a cutting plotter and a function as a printer. In the apparatus of this structure, the cutting head is held at the end of the guide rail when printing. Therefore, there is little chance that ink droplets ejected from the inkjet head during the printing adhere to the cutting head and its electric wires, thereby preventing the cutting head from being contaminated and preventing occurrence of operation error due to dissolution of covers of the electric wires.

When the first and second heads are respective inkjet heads, inks of different compositions such as aqueous ink and solvent ink can be handled by the first head and the second head, whereby inkjet printing of two types can be conducted singly by one printer. In this case, the driving member is preferably provided with a detector because the printing can be conducted with reference to values detected by the detector regardless of which inkjet head is used for the printing. When the driving member is provided with a separating means, a printed portion can be separated from the medium by using the separating means after the printing regardless of which inkjet head is used for the printing. The driving member is adapted to move in the lateral direction whenever printing is conducted regardless of which head is used. When devices and/or parts required for printing besides for ejecting ink are disposed on the driving member, increase in number of parts can be prevented.

Moreover, the cutting head may be provided with a spray unit for forming a coating layer on the surface of the sheet-like medium. Therefore, coating agent is sprayed from the spray unit onto the surface of the sheet-like medium with moving the cutting head, thereby forming a coating layer on the surface of the sheet-like medium. For example, it is possible to easily laminate the surface of the sheet-like medium.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A printer-plotter comprising:

a guide rail extending along a longitudinal direction;

a first head supported by said guide rail and movable along said longitudinal direction;

a second head supported by said guide rail and movable independently of the first head along said longitudinal direction;

a driving member supported by said guide rail and configured to move along said longitudinal direction between said first head and said second head;

a first connecting mechanism configured to connect said first head to said driving member detachably; and a second connecting mechanism configured to connect said second head to said driving member detachably wherein said first head is connected to said driving member by said first connecting mechanism and said second head is separated from said driving member in order to make said first head operate, wherein said second head is connected to said driving member by said second connecting mechanism and said first head is separated from said driving member in order to make said second head operate, wherein at least one of said first connecting mechanism and said second connecting mechanism includes a member having a projection, said projection being pivotally mounted to said member to pivot about an axis, said projection having a first position in which said projection is configured to engage said driving member to at least one of said first head and said second head and a second position in which said projection is configured to disengage said driving member from said at least one of said first head and said second head.

2. The printer-plotter according to claim 1, further comprising:

a first head holding mechanism configured to hold said first head at a first end of said guide rail; and a second head holding mechanism configured to hold said second head at a second end of said guide rail, wherein said second head holding mechanism holds said second head when said first head is connected to said driving member, and wherein said first head holding mechanism holds said first head when said second head is connected to said driving member.

3. The printer-plotter according to claim 1, wherein the printer-plotter comprises a traction device comprising:

a first pulley disposed at the first end of said guide rail;

a second pulley disposed at the second end of said guide rail;

a driving belt attached to said driving member and wound around said first and second pulleys to extend along said longitudinal direction; and a driving motor configured to rotate at least one of said first and second pulleys to move said driving belt along the longitudinal direction.

4. The printer-plotter according to claim 1, wherein the printer-plotter comprises a feeding mechanism configured to feed a sheet medium along a feeding direction substantially perpendicular to the longitudinal direction.

5. The printer-plotter according to claim 4, wherein said first head comprises a cutting head configured to cut the medium, and wherein said second head comprises an inkjet head configured to print on said medium.

6. The printer-plotter according to claim 5, wherein said cutting head comprises a spray unit configured to form a coating layer on a surface of said medium.

7. The printer-plotter according to claim 1, wherein said first head and said second head comprise an inkjet head configured to print on said medium, respectively.

8. The printer-plotter according to claim 7, wherein said driving member comprises a detector configured to detect a size of said medium.

9. The printer-plotter according to claim 7, wherein said driving member comprises a separator to separate said medium into a printed portion and an unprinted portion.

10. The printer-plotter according to claim 1, wherein said member is an L-shaped fixing member, wherein said projection is an L-shaped swinging member configured to form a U-shaped concavity having an opening with said L-shaped fixing member, and wherein said L-shaped swinging arm is biased towards closing the opening of the U-shaped concavity.

11. The printer-plotter according to claim 1, wherein said member is a pivot arm and wherein said projection includes recessed walls of a concavity on said pivot arm.

12. The printer-plotter according to claim 1, wherein said member is a pivot arm and wherein said projection includes an engaging member including a convexity.

13. The printer-plotter according to claim 1, wherein said member is a pivot plate and wherein said projection includes a hook.

14. A printer-plotter comprising:

a guide rail extending along a longitudinal direction;

a first head supported by said guide rail and movable along said longitudinal direction;

a second head supported by said guide rail and movable independently of the first head along said longitudinal direction;

driving means for moving along said longitudinal direction between said first head and said second head, the driving means being supported by said guide rail;

first connecting means for connecting said first head to said driving means detachably; and second connecting means for connecting said second head to said driving means detachably, wherein said first head is connected to said driving means by said first connecting means and said second head is separated from said driving means in order to make said first head operate, wherein said second head is connected to said driving means by said second connecting means and said first head is separated from said driving means in order to make said second head operate, and wherein at least one of said first connecting means and said second connecting means includes a member having a projection, said projection being pivotally mounted to said member to pivot about an axis, said projection having a first position in which said projection is configured to engage said driving means to at least one of said first head and said second head and a second position in which said projection is configured to disengage said driving means from said at least one of said first head and said second head.

15. A printer-plotter comprising:

a guide rail extending along a longitudinal direction;

a first head supported by said guide rail and movable along said longitudinal direction;

a second head supported by said guide rail and movable independently of the first head along said longitudinal direction;

a driving member supported by said guide rail and configured to move along said longitudinal direction between said first head and said second head;

a first connecting mechanism configured to connect said first head to said driving member detachably; and a second connecting mechanism configured to connect said second head to said driving member detachably wherein said first head is connected to said driving member by said first connecting mechanism and said second head is separated from said driving member in order to make said first head operate, wherein said second head is connected to said driving member by said second connecting mechanism and said first head is separated from said driving member in order to make said second head operate, and wherein at least one of said first connecting mechanism and said second connecting mechanism includes a slidably moving member configured to slidably move along said respective at least one of said first connecting mechanism and said second connecting mechanism, said slidably moving member having a first position in which said driving member is engaged to at least one of said first head and said second head and a second position in which said driving member is disengaged from said at least one of said first head and said second head.

16. The printer-plotter according to claim 15, wherein said at least one of said first connecting mechanism and said second connecting mechanism includes a push latch including said slidably moving member.

17. The printer-plotter according to claim 15, wherein said slidably moving member is an engaging member including a convexity.

18. The printer-plotter according to claim 15, wherein said slidably moving member is a receiving member having a cutout portion.

19. The printer-plotter according to claim 15, wherein said slidably moving member is a plate with a pin projecting therefrom.

20. A printer-plotter comprising:

a guide rail extending along a longitudinal direction;

a first head supported by said guide rail and movable along said longitudinal direction;

a second head supported by said guide rail and movable independently of the first head along said longitudinal direction;

a driving member supported by said guide rail and configured to move along said longitudinal direction between said first head and said second head;

a first connecting mechanism configured to connect said first head to said driving member detachably; and a second connecting mechanism configured to connect said second head to said driving member detachably wherein said first head is connected to said driving member by said first connecting mechanism and said second head is separated from said driving member in order to make said first head operate, wherein said second head is connected to said driving member by said second connecting mechanism and said first head is separated from said driving member in order to make said second head operate, and wherein at least one of said first connecting mechanism and said second connecting mechanism includes a hook and where at least one of said first head and said second head includes an opposing hook, and further comprising a driving device configured to drive said at least one of said first head and said second head in a direction perpendicular to said longitudinal direction in order to engage said hook and said opposing hook.

* * * * *